United States Patent [19]

Reinauer

[11] 4,372,821

[45] Feb. 8, 1983

[54] EMISSION CONTROL APPARATUS

[75] Inventor: Thomas V. Reinauer, Summit, N.J.

[73] Assignee: United States Filter Corporation, New York, N.Y.

[21] Appl. No.: 297,981

[22] Filed: Aug. 31, 1981

[51] Int. Cl.[3] ..... C10B 33/00; C10B 45/00

[52] U.S. Cl. ..... 202/263; 55/302

[58] Field of Search ..... 202/263; 55/302, 96; 266/157–159; 414/212

[56] References Cited

U.S. PATENT DOCUMENTS

| | | | |
|---|---|---|---|
| Re. 24,954 | 3/1961 | Church | 55/96 |
| 3,676,305 | 7/1972 | Cremer | 202/263 |
| 3,746,626 | 7/1973 | Morrison | 202/263 |
| 3,972,782 | 8/1976 | Patton | 202/263 |
| 4,146,435 | 3/1979 | Ueno et al. | 202/263 |
| 4,227,903 | 10/1980 | Gustavsson et al. | 55/302 |
| 4,306,888 | 12/1981 | Cheng | 55/302 |

*Primary Examiner*—Bradley Garris

*Attorney, Agent, or Firm*—Nims, Howes, Collison & Isner

[57] ABSTRACT

Improved system for controlling means attendant the discharge of coke ovens and for collecting particulate matter associated therewith by venting the exhaust gases through fabric filter means.

9 Claims, 2 Drawing Figures

EMISSION CONTROL APPARATUS

This invention relates to the field of air pollution control and, more particularly, to an improved system for controlling the emissions attendant the discharge of coke from coke ovens and for collecting particulate matter associated therewith.

The discharge of coke from a coke oven presents a difficult and offensive air pollution problem. When coke at a temperature of 2,000° F. is suddenly discharged from an oven into the waiting quench car, there is a massive release of heat to the surroundings. This heat release causes an emission in the form of a rapid and voluminous gaseous updraft containing significant amounts of varying sized particulates picked up from the coke. Subsequent fallout of these particulates from the emission scatters solid pollutants over neighboring areas extending a substantial distance from the coke oven battery while the smaller particles may remain suspended in the air for extended periods of time.

Various devices have been proposed in the art for the control of the emissions produced upon the pushing of coke from a coke oven. Most of these devices have included traveling hoods adapted to be positioned over either the coke guide or the quench car. Such a hood has typically been provided with a blower for removal of gases therefrom and a scrubber or other means for separation of the particulates from the gases. The effectiveness of such emission control systems has been limited since the volume of the hood is generally inadequate to contain the rapid gaseous surge which is produced as the oven is discharged. As a consequence, a substantial portion of the gases and particulates tend to escape and pollute the surrounding area. Given the limited volumetric capacity of these traveling hoods, such problems could be overcome only by providing an exceptionally high capacity exhaust system for the hood. This factor, together with the high energy scrubbing system needed to remove the high particulate load in the gases exhausted from the hood, requires a very high order of power consumption, for example, on the order of 2,000–3,000 hp. Such high energy scrubbing systems also tend to create concommitant water pollution problems attendant the disposition of the liquid effluent therefrom. Where such traveling hoods have been designed and adapted to cover areas within which workmen may be stationed, the hood tends to confine and concentrate the noxious gases and, as such, present a serious hazard to the workmen. Because of their size, weight and mechanical complexity and the severe environment in which they are used, traveling hoods are not only expensive to install and operate, but are also subject to potentially serious maintenance problems with attendant downtime and repair expense.

Many of the problems experienced with traveling hoods have been effectively resolved by the improved stationary emission control shed construction disclosed in Patton U.S. Pat. No. 3,972,782. In this system, an arched roof shed extends along the coke delivery side of a coke oven battery. A longitudinal upright partition within the shed serves to divide it into an elongate entrapment chamber adjacent the coke delivery side of the battery for containing the emissions and an elongate expansion chamber extending parallel to and offset laterally from the expansion chamber. The partition also functions as a heat shield having one side thereof facing the coke oven discharge doors and located across the quench car tracks therefrom. The upper end of such partition, in association with the adjacent portion of the arched roof, operates to define a flow restriction for accelerating the upwardly moving gaseous updraft leaving the entrapment chamber to enhance the entrainment of larger size particulates therein and thus inhibit particulate settlement in the entrapment chamber as well as to assure transport of substantially all of the particulates over into the expansion chamber where the gas velocity is markedly reduced and the larger particulates settle out under the influence of gravity. A plurality of hopper assembly modules are incorporated at the bottom of the expansion chamber for collection of the separated particulates and transport thereof from the system.

Although the apparatus described in the aforesaid patent is markedly superior to those previously known or employed, its construction and operation involves the utilization of an elaborate internal gaseous exhaust system that requires a relatively large amount of power to operate as well as a separate auxiliary dust collection system to remove entrained particulates from the exhausted gaseous carrier. Such internal gaseous exhaust system includes a main exhaust duct that runs the full length of the shed and which is suitably varying cross-sectioned configuration to provide substantially constant gas velocity at all points therewithin. The design of such duct, manifold and gas entry ports are directed to attain a pressure drop low enough to assure that the gas flow through the flow restriction be substantially the same along the entire length of the shed, and also to afford a gas velocity within the duct that is high enough to avoid any significant settling of dust particles within the duct as the carrier gas is being vented from the expansion chamber.

SUMMARY OF THE INVENTION

This invention may be briefly described as an improved emission control apparatus of the general type disclosed in the aforesaid U.S. Pat. No. 3,972,782 and which, in its broad aspects, includes a simplified expansion chamber construction devoid of duct work and incorporating a plurality of selectively located fabric filter modules disposed therewithin. In its narrower aspects the subject invention includes the provision of an expansion chamber in emission control apparatus of the type herein of concern from which effectively all particulate bearing carrier gases are vented, substantially devoid of particulates, to the atmosphere through internally located fabric filters that are located out of the path of gravity induced fall of heavier particulates so as to effectively limit the loading of the fabric filter media thereof to those smaller sized particulates that would remain entrained in a slowly moving gaseous stream.

In addition to the manifold advantages attendant the improved emission control apparatus of U.S. Pat. No. 3,972,782, further advantages attendant practice of the subject invention are the provision of a unitary emission control structure that affords appreciable floor space economies; the permitted elimination of the externally located auxillary filtering or scrubbing apparatus conventionally required for separation of particulates from the exhaust gas stream before release thereof to the atmosphere; a marked reduction in fan power requirements and attendant installation and operating costs and a permitted simplification of the internally located fabric filter module construction through utilization of the shed wall as a component of the housings therefor.

The primary object of this invention is the provision of improved emission control apparatus for coke oven batteries and like facilities.

Another object of this invention is the provision of an improved venting system for emission control apparatus for coke oven batteries and like facilities.

Other objects and advantages of the subject invention will be apparent from the following portions of this specification and from the appended drawings which disclose, in accord with the mandate of the patent statutes, the best mode currently contemplated by me to carry out the invention.

DESCRIPTION OF THE PREFERRED EMBODIMENT

Figure 1:
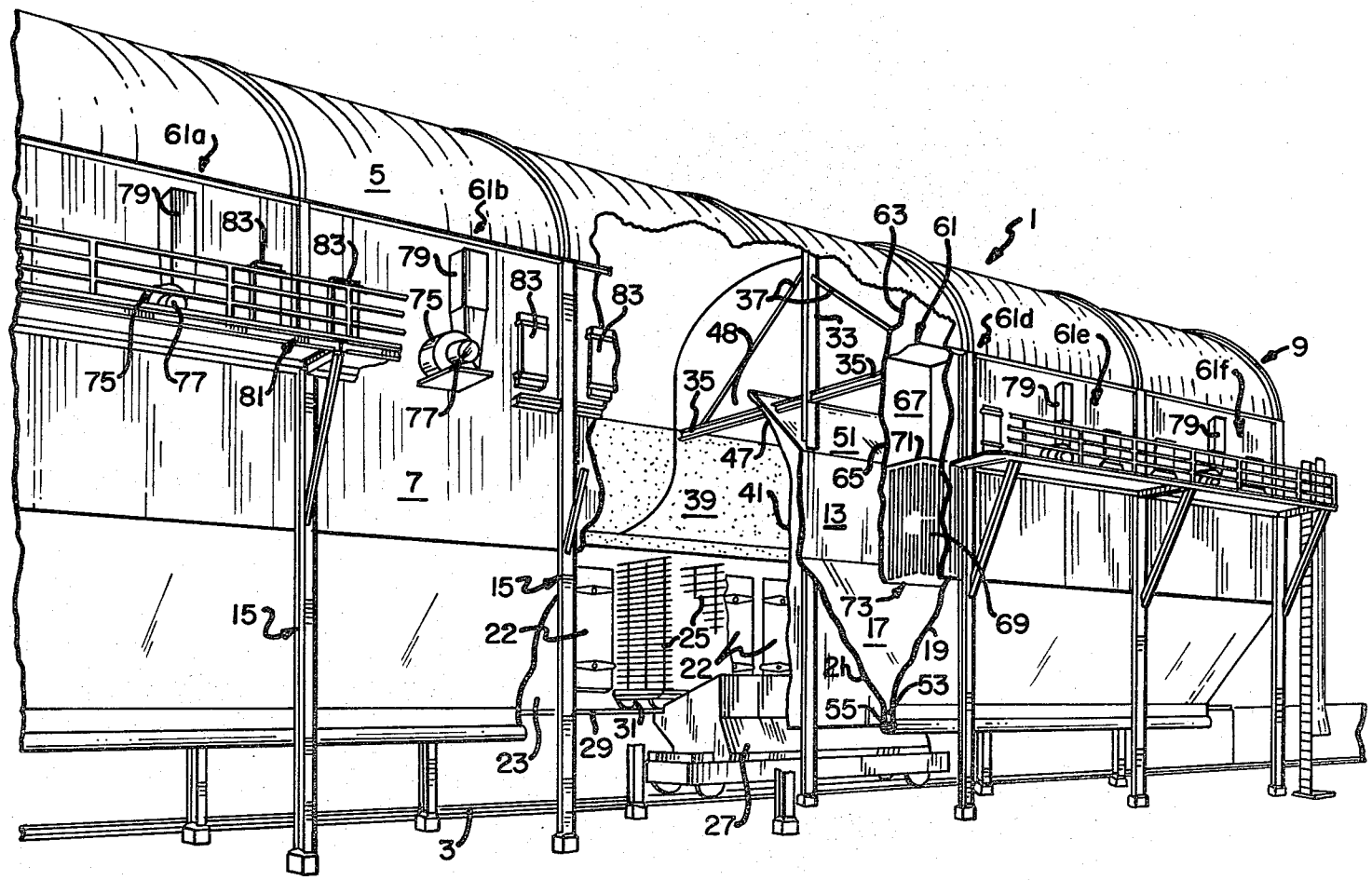
FIG. 1 is an external oblique view, partially broken away, of emission control apparatus embodying the principles of this invention.
Figure 2:
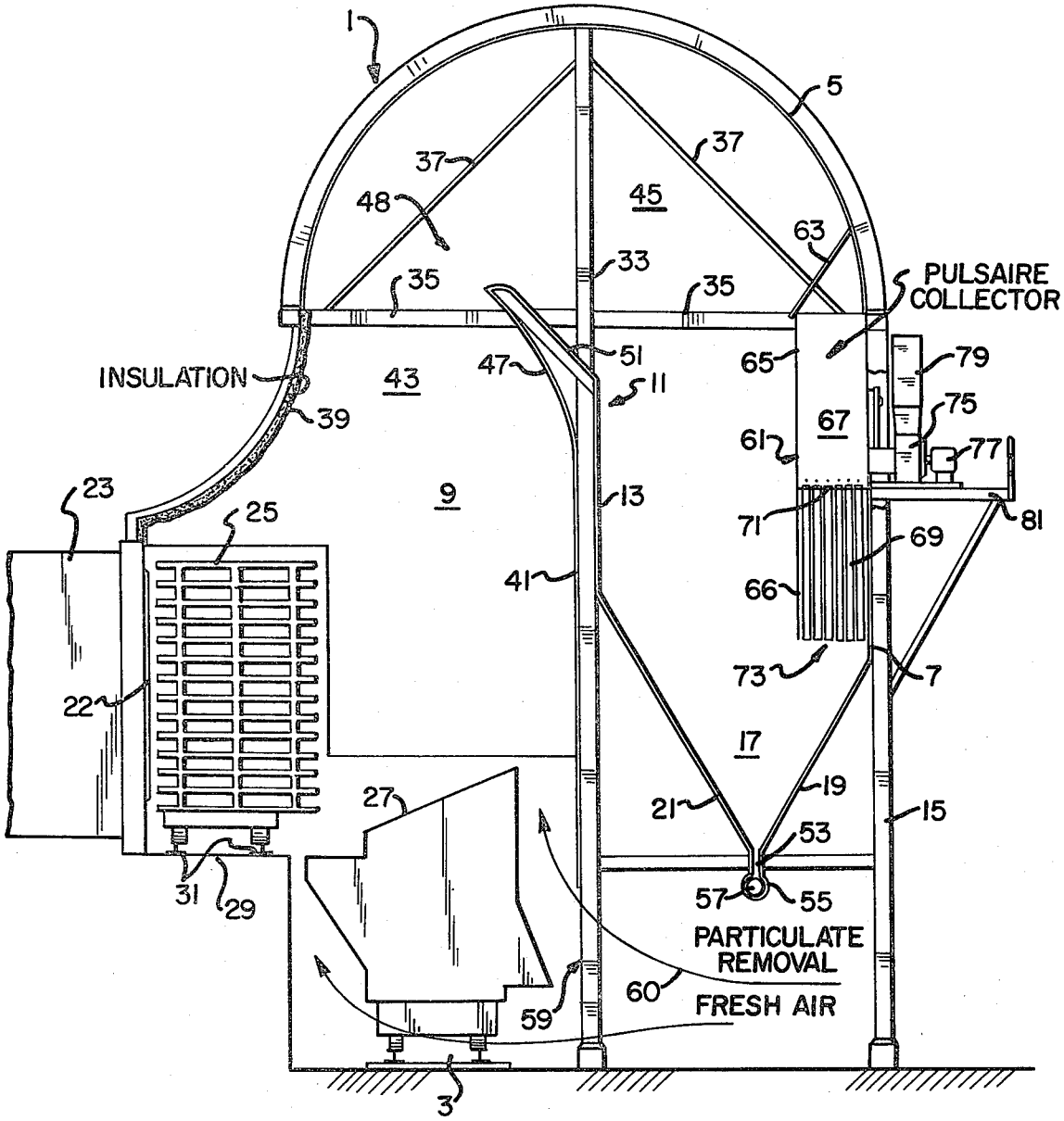
FIG. 2 is a cross-section of FIG. 1.

Referring to the drawings, there is shown emission control apparatus for a battery of coke ovens of the general configuration shown in the Patton U.S. Pat. No. 3,972,782. Such apparatus includes an elongate shed 1 installed over quench car track 3 on the coke delivery side of a coke oven battery made up of a plurality of coke ovens 23. The emissions caused by the discharge of coke from a coke oven are adapted to be contained within this shed and, in the instant invention, substantially particulate free gas vented to the atmosphere therefrom. Such shed includes a laterally arched roof 5, a vertical outer wall 7, and vertical end walls 9. The structure is supported by its own steelwork, including side columns 15.

Disposed along one side of the shed, and indicated by the coke oven doors 22, is the discharge side of a coke oven battery. When coke is pushed from an oven 23, as through an opened door 22, it passes through coke guide 25 into a quench car 27 positioned on the track 3. The coke guide 25 is supported on a dock 29 and is moved from oven to oven along a second track 31.

The roof of shed 1 extends over quench car track 3 at a level appreciably above the tops of the ovens 23 forming the battery, and is supported by internal columns 33, lateral beams 35 (which are in turn stabilized by rods 37) and by the aforesaid outer columns 15. An insulated panel 39 closes the gap between the inward dependent edge of roof 5 and the discharge end of the coke oven battery and, in the illustrated embodiment and as will be further explained later cooperates in directing the emission into the flow restrictions zone 48. A longitudinal upright partition 41 located along the line of columns 33 constitutes a divide and separating wall and a heat shield facing the oven discharge doors 22 and located across the quench car track therefrom. Such partition 41 serves to contain the radiant heat released upon pushing of coke from the oven into the quench car 27 and may be either constructed of heat-resistant material or be lined with heat-resistant material on the side thereof facing the oven discharge doors. A preferred material of construction for such partition is corrugated stainless steel. Because of its exposure to hot gases for a short duration at temperatures in the range of 800°–1,000° F., roof 5 is also constructed of a heat-resistant material such as stainless steel.

The longitudinal partition 41 also serves to divide the shed 1 into an elongate entrapment chamber, generally designated 43, extending along and adjacent to the discharge side of the coke battery and into an elongate expansion chamber, generally designated 45, extending parallel to and offset laterally from the entrapment chamber. The emission caused by discharge of coke from an oven 23 is adapted to be contained by the entrapment chamber 43 and the updraft of hot gases and particulates comprising the emission subsequently pass over the partition 41 and into the expansion chamber 45 where the gas velocity is reduced and the relatively heavy particulates gravity separate from the gaseous carrier. Since both the entrapment and expansion chambers extend alongside the entire battery of the coke ovens 23, the emission may also expand longitudinally within the entrapment chamber and pass over to the expansion chamber without escaping to the surrounding atmosphere.

The upper end of the longitudinal partition 41 includes an inwardly directed projection or deflection plate 47. The upper end portion of the insulated panel 39, the adjacent portion of the roof 5 and the projection 47 at the upper end of partition 41 cooperate to define a flow restriction zone 48 in the vicinity of the lower edge of the arched roof 5 in the path of the hot gases moving upwardly from entrapment chamber 43 enroute to the expansion chamber 45. This flow restriction serves effectively as a capture orifice, causing the upwardly moving hot gases leaving the entrapment chamber 43 to be further accelerated to enhance the entrainment of suspended particulates therein and to concommitantly inhibit settling of particulates in the entrapment chamber. Advantageously, the partition 41 is substantially centrally located underneath the vertex of roof 5, and the projection 47 is canted toward the portion of the roof nearest to the coke oven batter, so that the flow restriction is located essentially directly in the upwardly directed portion of the flow path of the emission from entrapment chamber 43 to expansion chamber 45, and to thus increase the effective transverse extent and volume of the expansion chamber 45. Preferably, projection 47 is canted to such an extent that the plane of the throat (narrowest cross-section) of the flow restriction 48 is at an angle of approximately 45° to the vertical. Such location of the flow restriction operates to minimize the fallout of particulates in chamber 43 by causing acceleration of gases in a region relatively close to the zone in which the coke is discharged.

The expansion chamber 45 extends downstream from the flow restriction zone 48. Such chamber is perimetrically defined by the portion of the arched roof 5 downstream of restriction zone 48, a second deflection panel 51 extending rearwardly from and downstream of the restriction zone 48 to direct any separated particulates further into the expansion chamber and toward the hopper section 17; the outerwall 7; an inner wall 11 which may comprise the rear surface of partition 41 but preferably comprises a smooth discrete wall panel 13 and the aforesaid dependent hopper means 17 running substantially the full length of the shed.

The hopper means 17 may be of conventional configuration and is here schematically illustrated as a trough type hopper formed by a pair of longitudinally disposed converging walls 19 and 21 dependent from the lower marginal edges of the outer wall 7 and inner wall panel 13 respectively. The converging walls 19 and 21 terminate in a longitudinal channel 53 of narrow transverse dimension that communicates with a dependent cylindrical channel 55 adapted to contain an auger 57 or other suitable solids displacing device. As will be apparent to those skilled in this art a plurality of hopper modules, each with its own particulate removal mechanism, could be employed in lieu of the illustrated trough type hopper. As illustrated, the bottom of the trough type hopper section 17 and the lower edge of the partition 41 are disposed above the floor or ground level thus permitting an inflow path for ambient air along the full length of the coke battery through the aperture 59, as indicated by the arrow 60.

The expansion chamber 45 is vented through a plurality of selectively positioned fabric filter assemblies, generally designated 61, operatively disposed therewithin. The filter media in such fabric filter assemblies may be of woven or felted character such as that conventionally employed in such type apparatus. As shown, such filter assemblies are disposed in longitudinally spaced relation along the length of the shed 1 as generally indicated by the reference numerals 61*a*, 61*b*, 61*c* etc. in FIG. 1 of the drawings to provide a general uniformity of transverse gas flow within the expansion chamber. Each such filter is located in abutting relation with the outer wall 7 immediately below the arched roof 5 and dependently terminate within the general hopper confines as, for example, adjacent the line of juncture between outer wall 7 and hopper wall 19.

Each of the fabric filter assemblies 61 includes a slanted roof panel 63 to prevent undue particulate accummulation thereon, a perimetric air impervious housing 65, one component of which may conveniently be the outer wall 7 defining a plenum chamber 67 and a skirt or shroud 66 for the fabric filter media. The underside of the plenum chamber 67 is defined by a tube sheet 71 and a plurality of elongate fabric filter socks or tubes 69 are dependently mounted on the tube sheet 71 and extend downwardly therefrom. As shown, the fabric filter socks or tubes 69 are closed at the bottom and are disposed in gaseous communication with the expansion chambr 45 through the open bottom 73 of the housing. Selectively directed gaseous flow from the dependent hopper area of the expansion chamber 45, through the open bottom 73 of the housing, the fabric filter media of the filter socks 69 and into the plenum chamber 67 is induced by individual externally disposed fans 75 powered by electric motors 77 and is vented to the atmosphere through exhaust conduits 79.

Access to the fabric filter assemblies and to the motor powered fans is provided by means of an external catwalk 81 and suitable doors 83 in the outer wall 7.

The fabric filter assemblies 61 are preferably of the so-called pulse jet type wherein removal of the accummulated particulates from the upstream side of the filter fabric is periodically effected by release of a selectively located momentary burst or jet of high energy gaseous fluid in a direction opposite to that of normal filter flow. A preferred fabric filter of this type is the "Mikro-Pulsaire" collector as manufactured and sold by the Mikropul Corporation of Summit, New Jersey and whose operative essentials were disclosed and claimed in Church U.S. Pat. No. Re. 24,954. Fabric filters employing other cleaning techniques such as reverse flow, mechanical shaking or other known expedients may, although not preferred, be employed.

In normal operation of the described structure one or more of the filter assemblies are kept in operation intermediate periods of coke discharge to assure a positive air flow through the shed 1 through maintenance of a slight negative pressure therein. As a result thereof ambient air is continuously drawn into the entrapment chamber 43 through the aperture 59, to not only provide requisite ventilation for the working areas on the discharge side of the battery of coke ovens but also to minimize emission escape through the aperture 59 and to assist in the entrainment of particulates within the entrapment chamber 43 when the emission expands along the length thereof following coke oven discharge.

In the operation of the subject apparatus, the emission generated by the massive release of heat attendant discharge of coke from an oven 23 expands longitudinally within the entrapment chamber 43 and creates a rapid and voluminous gaseous updraft that contains significant amounts of varying sized particulates. Such upwardly moving gases are accelerated by passage through the flow restriction 48 at velocities desirably in excess of 100 feet/min. The smooth internal contour and trussless support of the arch roof 5 affords a streamlined path for the gases and entrained particulates in their passage from the entrapment chamber 43 to the expansion chamber 45, thus further minimizing any tendency toward particle recirculation and fallout within the entrapment chamber 43.

As is apparent, expansion chamber 45 extends downstream from the flow restriction zone 48 and is of substantially greater effective volume than the entrapment chamber 43. In the expansion chamber 45, the gas velocity is markedly reduced due to the combined effect of increased flow cross-section and the cooling of the gases by heat loss. As a result of such reduced gas velocity, the relatively heavier and normally larger sized particulates fall out of the gases along a settling path whose gravity component is in a direction entirely downstream from the entrapment chamber and downward into the hopper section 17. The location of the flow restriction 48 shown in the drawings affords a relatively large volume and long flow path within the expansion chamber as compared to the entrapment chamber, thus assuring that the gas cooling, velocity reduction and particulate settling are practically entirely confined to the expansion chamber 45 rather than the entrapment chamber 43.

All of the particulates that are subject to gravity induced separation are directed by the steeply converging walls 19 and 21 of the trough type hopper 17 into the channel 55 through slot 53 where they are readily removed from the system.

Since the expansion chamber 45 is vented through the fabric filter assemblies 61*a*, 61*b* et seq., all of the gases therewithin must pass through the fabric filter media. During such passage effectively all of the remaining particulates entrained or suspended therein will be separated from the carrier gas and will accummulate on the exterior surface of the fabric filter media. As shown in the drawings, the filter assemblies 61 are located so as to minimize, if not avoid, any interference with the settling paths for the heavier particulates and the perimetric housings, in permitting gas entry only through the open bottom 73 of the housing, effectively isolates the filter media from contact with the heavier particulates with attendant diminution of loading thereof and resultant operating economies. Such bottom opening gas entry aperture 73 is also disposed at a locus of effectively minimum gas velocity within the hopper portion of the expansion chamber thus affording maximum opportunity for gravity induced particulate separation as well as for minimum reentrainment of particulates displaced from the filter media during the cleaning cycles, which are also then subject to gravity induced displacement through the open bottom 73 down into hopper section 17.

The self-contained filter vented emission control apparatus as described above provides an advantageous, economic and highly efficient system for controlling the emissions incident to the discharge of coke ovens and like installations. The continuous operation of the filter assemblies 61*a* et seq. maintains, with markedly reduced power requirements determined by the pressure drop across the tube sheets and hood entry loss, a negative pressure within the emission entrapment zone with access provided through aperture 59 for continuous introduction of ambient air at a linear velocity in the range of 50 to 75 feet/min. Downstream of the flow restriction 48, the gas velocity is markedly reduced for the reasons heretofore pointed out, desirably below about 40 to 50 feet/min. in the area adjacent the top of the hopper section 17 and from which area the gases are vented to the atmosphere through the fabric filter assemblies.

Having thus described my invention, I claim:

1. Apparatus for controlling the gaseous and particulate emissions from a battery of coke ovens occasioned by the discharge of coke from the individual ovens constituting the same comprising a shed extending along the coke delivery side of said battery of coke ovens having a roof of progressively increasing elevation adjacent the coke delivery side of said ovens, spaced external end walls and an external outer wall, a longitudinal upright partition within said shed disposed intermediate said outer wall and the delivery side of said battery of coke ovens and dividing said shed into an elongate emission entrapment chamber for containing the gaseous and particulate emissions attendant coke discharge and an expansion chamber extending parallel to and offset laterally from the entrapment chamber, flow restriction means disposed at the upper end of said elongate emission entrapment chamber for accelerating the velocity of the gaseous emission attendant coke discharge leaving said entrapment chamber so that particulate matter is inhibited from settling in said entrapment chamber and is carried into said expansion chamber where gas velocity is reduced and gravity induced separation of entrained particulates is effected, said expansion chamber dependently terminating in a sloped wall hopper means for collection separated particulate matter, means for venting said expansion chamber and for separating nonsettled particulates from said emitted gaseous carrier consisting essentially of filter means and fan means, said filter means employing fabric filter media and having a plurality of outlets disposed within said expansion chamber and mounted adjacent an external shed wall, said fan means connected to said filter means for inducing a directed flow of said emitted gaseous carrier from said expansion chamber, through said fabric filter medium and externally of said shed and with an attendant accumulation of emitted particulate matter on the upstream side of said fabric filter medium, and means for effecting the periodic removal of said accumulated particulate matter from said fabric filter medium and introduction thereof into said hopper means.

2. Apparatus as set forth in claim 1 wherein said filter means comprises a plurality of discrete filter assemblies disposed in predetermined longitudinal spaced relation within said expansion chamber.

3. Apparatus as set forth in claim 1 wherein said filter means comprises a plurality of discrete and individually powered pulse jet type filter assemblies disposed in predetermined longitudinal spaced relation within said expansion chamber.

4. Apparatus as set forth in claim 1 wherein entry of gaseous carrier and entrained particulate matter into said filter means is effected within said hopper means.

5. Apparatus as set forth in claim 1 wherein said filter means comprises a plurality of discrete filter assemblies disposed in predetermined longitudinal spaced relation within said expansion chamber and mounted on the outer wall of said shed.

6. Apparatus as set forth in claim 5 wherein each of said filter assemblies further comprises a perimetric housing defining a plenum chamber and a filter chamber.

7. Apparatus as set forth in claim 6 wherein said filter chamber includes a plurality of fabric filter socks perimetrically shrouded by said perimetric housing and with a gaseous carrier entry thereto at the bottom of said housing.

8. Apparatus as set forth in claim 7 wherein said gaseous carrier entry is located within said hopper means.

9. Apparatus as set forth in claim 1 wherein said flow restriction means is formed in part by an angularly disposed extension on the upper end of said longitudinal upright partition.

* * * * *